US005209350A

United States Patent [19]

Maeng

[11] Patent Number: 5,209,350

[45] Date of Patent: May 11, 1993

[54] GOLF BAG WITH SUPPORT STAND

[76] Inventor: Seop Maeng, Hanyang Apt. 22-102, Songpa-Dong, Songpa-Ku, Seoul, Rep. of Korea

[21] Appl. No.: 746,356

[22] Filed: Aug. 16, 1991

[30] Foreign Application Priority Data

Jun. 26, 1991 [KR] Rep. of Korea ..... 9660/1991

[51] Int. Cl.[5] ..... A63B 55/06

[52] U.S. Cl. ..... 206/315.7; 248/96

[58] Field of Search ..... 206/315.2, 315.3, 315.7, 206/315.8; 248/96

[56] References Cited

U.S. PATENT DOCUMENTS

| | | | |
|---|---|---|---|
| 646,869 | 4/1900 | Perkes | 206/315.7 X |
| 1,757,471 | 5/1930 | Platt | 248/96 |
| 2,079,551 | 5/1937 | Eicholtz | 248/96 X |
| 2,902,238 | 9/1959 | Tolman | 248/96 |
| 4,506,854 | 3/1985 | Kim | 248/96 |
| 4,778,136 | 10/1988 | Reimers | 206/315.7 X |
| 4,798,357 | 1/1989 | Cho | 206/315.7 X |
| 4,834,235 | 5/1989 | Solheim et al. | 206/315.7 |
| 4,949,844 | 8/1990 | Yang | 206/315.7 |
| 5,036,974 | 8/1991 | Ross, Jr. | 248/96 X |
| 5,042,654 | 8/1991 | Jones | 206/315.7 X |

FOREIGN PATENT DOCUMENTS

| | | | |
|---|---|---|---|
| 155266 | 3/1921 | United Kingdom | 206/315.6 |
| 398550 | 9/1933 | United Kingdom | 206/315.6 |
| 407324 | 3/1934 | United Kingdom | 206/315.6 |
| 806799 | 12/1958 | United Kingdom | 206/315.2 |
| 209807 | 11/1982 | United Kingdom | 248/96 |

*Primary Examiner*—Sue A. Weaver

*Attorney, Agent, or Firm*—Schmeiser, Morelle & Watts

[57] ABSTRACT

A golf bag comprising a pair of support legs pivotally mounted at their upper ends to the bag, so as to pivot between extended and retracted positions thereof. A base plate is pivotally mounted to the bottom of the bag. The base plate has sufficient width and length to stably support the bag. The bag also includes a plurality of downwardly extending base members provided at the lower surface of bottom member, except for at least the front portion of said lower surface. Each of base members has a certain vertical length such that its bottom surface is flush with the lower surface of base plate and in contact with the ground when the bag body is maintained at its upright position. The stability of the bag is ensured at both inclined and upright positions, in that the base plate is always in contact with the ground.

9 Claims, 5 Drawing Sheets

GOLF BAG WITH SUPPORT STAND

BACKGROUND OF THE INVENTION

1. Field of the Invention

The present invention relates to golf bags, and more particularly to golf bags with support stands wherein a pair of legs are movable between their extended position and their retracted position.

2. Description of the Prior Art

Conventionally, there have been proposed various golf bags which have legs movable between their extended and retracted positions. For example, U.S. Pat. No. 4,676,464 disclosed a golf bag with an integral stand which comprises a pair of legs pivotally mounted at the upper ends thereof on the upper portion of golf bag, a pair of shoulder pads connected at the upper ends thereof to the uppermost ends of the legs, respectively, and a pair of clamps fixedly mounted to the lower ends of the shoulder pads and adapted to fit around and slide along the legs, respectively. As the shoulder pads are lifted for carrying the golf bag, the clamps slide upwardly along the legs, thereby causing the legs to be retracted. On the other hand, the shoulder pads are free, the lower ends of the shoulder pads made of an elastic material such as nylon codes are extended by virtue of their elasticity, so that the clamps slide and push the legs, thereby causing the legs to extend in order to function as a stand. Thus, this construction has improved convenience in use, over the prior arts, because the legs are automatically retracted in carrying the golf bag and automatically extended in using or storage thereof.

However, this construction has inconvenience in storage, since even in storage, the legs are automatically extended. Also, to carry or store the golf bag under the condition of extending the legs causes the necessity of large space, thereby the transportation efficiency to be decreased. Furthermore, the construction should have a base member of special shape which makes impossible to apply the construction to most commonly used golf bags.

Another golf bag has been disclosed in U.S. Pat. No. 4,921,192. In this patent, a front half portion of the base of the bag is formed inclinedly so that as the inclined base portion is brought into contact with the ground, a vertically extending actuating rod, which is disposed at the side of bag adjacent the inclined base portion and is movable upwardly and downwardly, is lifted to extend legs. This construction also have the disadvantage that it can not be used in general types of golf bags, because of requiring the inclined base. Furthermore, this inclined base causes the disadvantage that the golf bag falls down easily, in that the ground contact area thereof is only a part of the bottom surface of the base. In the case that golf clubs are contained in the golf bag, it is difficult to maintain the golf bag at its upright position, because only the horizontal surface of the the base should support the heavy weights of golf clubs. As a result, the golf bag is naturally maintained at its inclined position where the inclined surface of the base is in contact with the ground and legs are maintained at their extended position. Consequently, the golf bag can be hardly stored at its upright position under the condition of containing golf clubs therein. Large storage space is also needed, in that in storage, the legs are naturally maintained at their extended position.

In the above-mentioned construction, there is also a disadvantage of requiring a special inner construction which prevents handles of golf clubs contained in the bag from sliding along the inner inclined surface of the base at the upright position of the bag.

Although above-mentioned patents are mainly intended for improving the stability of golf bag at the extended position of the legs, by increasing the ground contact area of the base, the constructions required therefor rather causes another serious disadvantages mentioned above.

SUMMARY OF THE INVENTION

Therefore, an object of the present invention is to overcome the above-mentioned disadvantages encountered in the prior arts and to provide an improved golf bag with a support stand which provides a sufficient ground contact area to support stably the bag at both upright and inclined positions thereof.

Another object of the present invention is to provide a golf bag with a support stand which can be stably maintained at its upright position without extending legs, even under the condition of containing golf clubs therein.

Another object of the present invention is to provide a golf bag with a support stand which requires no provision of preventing legs from extending in positioning of the bag at its upright position.

Another object of the present invention is to provide a golf bag with a support stand wherein legs can be easily extended by their weights as the bag moves to its inclined position and automatically retracted as the bag moves to its upright position.

A further object of the present invention is to provide a golf bag with a support stand which can be easily applied to various types of existing golf bags, without requiring any separate construction, in particular, a special inner construction of bag.

In accordance with the present invention, these objects can be accomplished by providing a golf bag comprising a bag body and a pair of support legs pivotally mounted at their upper ends to said bag body by means of pivot members attached to the bag body, respectively, so as to pivot between extended and retracted positions thereof, the golf bag further comprising: a bottom member constituting the bottom of bag body and having a flat lower surface; a base plate disposed beneath said bottom member to be contactable with the ground and pivotally connected to the bottom member, by means of a generally U-shaped connecting rod pivotally mounted to said lower surface of the bottom member, said base plate having at least one first pivot member to which the lower end of said connecting rod is pivotally connected so that the bag body pivots between its inclined and upright positions about said pivot member on the base member which is in contact with the ground; actuating means adapted to pivot said legs according to the pivoting of bag body; and a plurality of downwardly extending base members provided at the lower surface of bottom member, except for at least the front portion of said lower surface, and arranged radially and inwardly from the periphery of the lower surface of bottom member and circumferentially spaced from one another, each of said base members having a certain vertical length such that its bottom surface is flush with the lower surface of base plate when the bag body is maintained at its upright position.

BRIEF DESCRIPTION OF THE DRAWINGS

Other objects and advantages of the present invention will become apparent from the following description of embodiments with reference to the accompanying drawings in which.

DETAILED DESCRIPTION OF THE PREFERRED EMBODIMENTS

Figure 1:
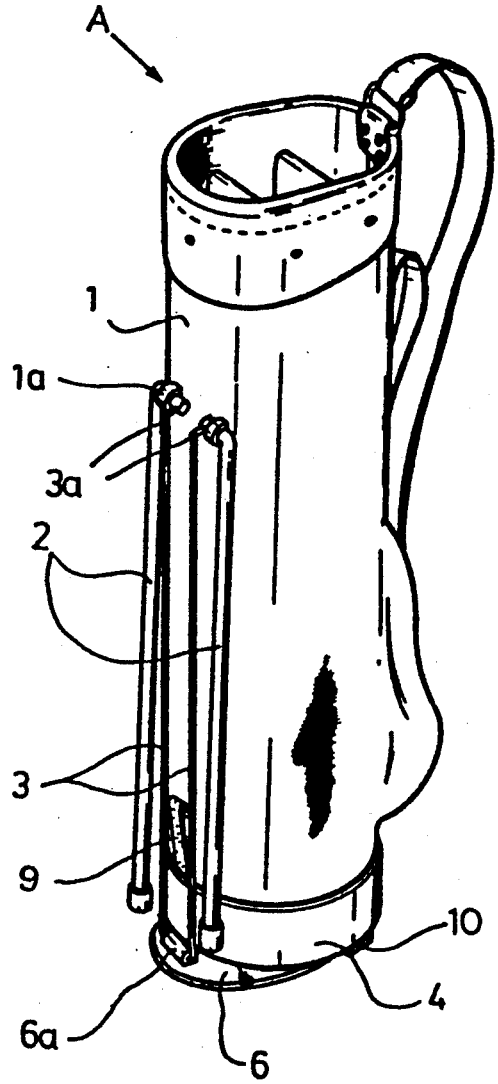
FIG. 1 is a perspective view of a golf bag with a support stand in accordance with an embodiment of the present invention, which bag is maintained at its upright position.

Referring to FIGS. 1 to 4, there is shown a golf bag in accordance with an embodiment of the present invention. The golf bag A comprises a bag body 1, a pair of support legs 2 pivotally mounted at their upper ends to said bag body 1 by means a pivot member 1*a* attached to the bag body 1, and a bottom member 4 constituting the bottom of bag body 1 and having a flat lower surface. For pivotally moving the legs 2 between extended and retracted positions thereof as the golf bag A moves between its inclined and upright positions, the golf bag A also comprises a generally U-shaped actuating member 3 having upper ends pivotally mounted to the upper ends of legs 2 by means of pivot members 3*a* fixedly attached to said upper ends of legs 2, respectively. The actuating member 3 is movable upwardly and downwardly to move the legs 2 between extended and retracted positions thereof.

Beneath the bottom member 4, a base plate 6 contactable with the ground is disposed. The base plate 6 is pivotally connected to the bottom member 4, by means of a generally U-shaped connecting rod 5 pivotally mounted to the lower surface of the bottom member 4. As shown in FIG. 2, the base plate 6 has a pair of first pivot members 5*a* pivotally connected with the lower end of the connecting rod 5 so as to pivotally connect the connecting rod 5 to the base plate 6, and a second pivot member 6*a* adapted to pivotally connected with the lower end of the actuating member 3 so as to pivotally connect the actuating member 3 to the base plate 6. The base plate 6 has a front portion extending beyond the bottom member 4 away from the center of the bottom member 4 and rear portion extending to the place near the center of the bottom member 4. In the embodiment shown in FIGS. 1 to 4, the first pivot members 5*a* are positioned beneath the bottom member 4. On the other hand, the second pivot member 6*a* is positioned at the front portion of base plate 6 outside the bottom member 4, so that the actuating member 3 is arranged outside the bag body 1 when viewed in side elevation. In order to normally maintain the legs 2 at the retracted position thereof, a resilient member 9 is provided which is connected at one end thereof to the actuating member 3 and at the other end thereof to the bag body 1, so as to always urge the actuating member 3 downwardly, that is, in the direction of forcing the legs 2 to move to the retracted position thereof. The downwardly protruded length of the actuating member 3 beyond the lower surface of bottom member 4 at the retracted position of legs 2 and the upright position of bag body 1 is substantially the same as the vertical length of the connecting rod 5 so that the lower surface of the bottom member 4 is maintained horizontally and in parallel to the base plate 6 which is in contact with the ground.

Figure 3:
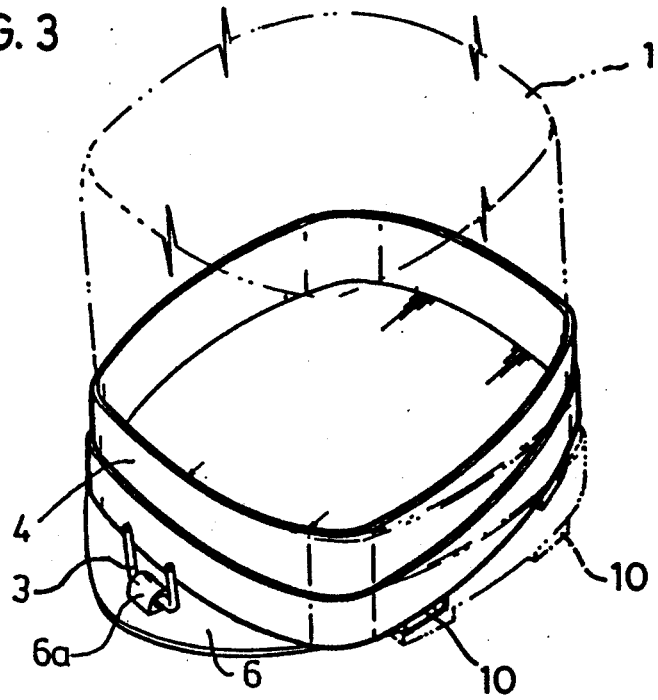
FIG. 3 is a view similar to FIG. 2, showing the condition that the bag is maintained at its inclined position.
Figure 4:
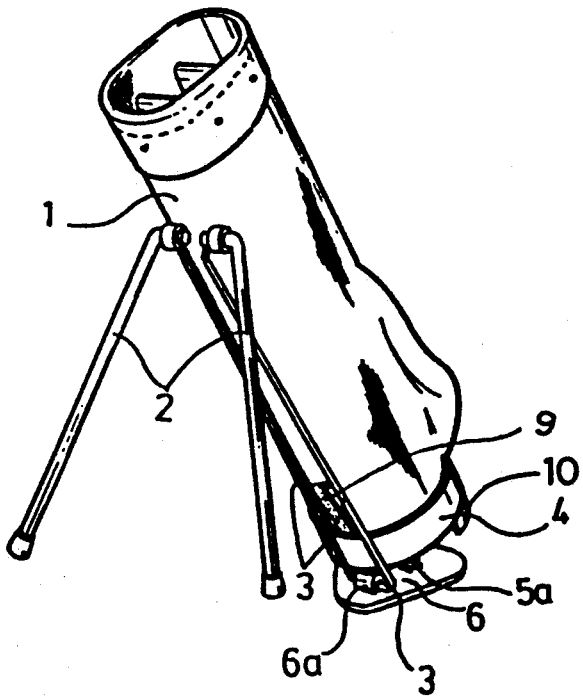
FIG. 4 is a perspective view of the golf bag of FIG. 1, showing the condition that it is stably maintained at its inclined position.

A plurality of downwardly extending base members 10 are provided at the lower surface of bottom member 4, except for at least the front portion of said lower surface, and arranged radially and inwardly from the periphery of the lower surface of bottom member 4 and circumferentially spaced from one another. Each base member 10 has a certain vertical length such that its bottom surface is flush with the lower surface of base plate when the bag body 1 is maintained at its upright position. With this arrangement, all of the base plate 6 and the base members 10 are in contact with the ground at the upright position of the bag body 1, so that the golf bag A can be stably maintained at its upright position. The base members 10 therefore comprise a plurality which extend downwardly from the base bottom member 4, except for at least the front portion of the lower surface, which plurality is arranged radially and inwardly from the periphery of the lower surface of the bottom member. As depicted in FIG. 3, the base members 10 are circumferentially spaced from one another and possess a length such that the bottom surfaces of the members are flush with the lower surface of the base plate 6 when the bag body is maintained at its upright position and the base plate 6 is disposed between the members 10 and lies essentially in a plane parallel to the bottom member 4, as shown in FIG. 1.

Figure 6:
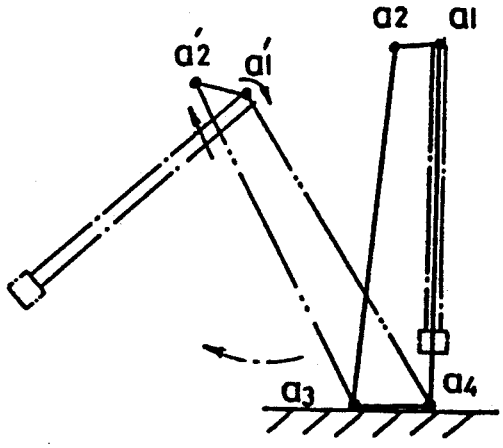
FIG. 6 is an explanation of a principle of the operations of legs.

According to the above construction, a parallelogram link mechanism is formed, as shown in FIG. 6. The link mechanism has four pivot points a1 to a4 which are provided by four pivot members 1*a*, 3*a*, 6*a* and 5*a*, respectively, and four links which are linked with one another at said pivot points and provided by the pivot member 3*a*, the actuating member 3, the base plate 6 and the bag body 1, respectively.

The operation of the above-mentioned construction will now be described in conjunction with the link mechanism.

Figure 2:
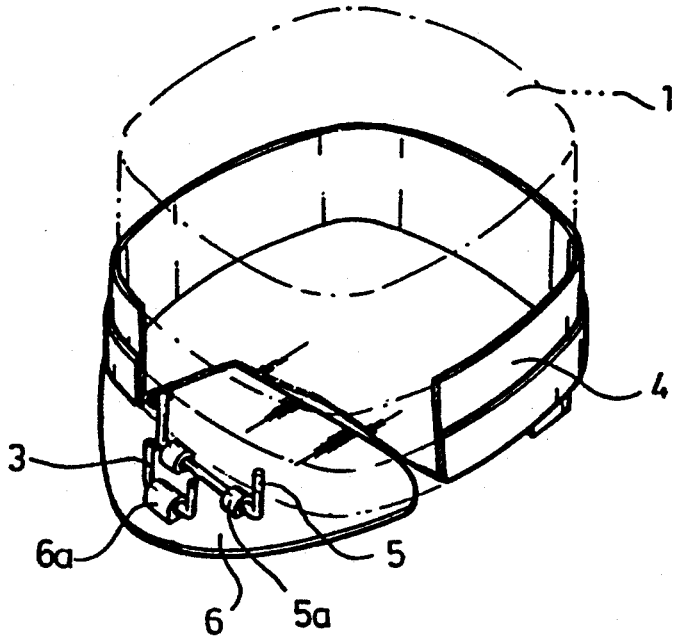
FIG. 2 is a partially broken-out perspective view of a bottom member of the golf bag of FIG. 1 maintained at its upright position, showing a base plate pivotally mounted to the bottom member.

In the normal state that golf bag A is maintained at its upright position, the base plate 6 which is connected to the bottom member 4 by means of the hinge member 5*a* is maintained in parallel to the horizontally maintained lower surface of bottom member 4, as shown in FIGS. 1 and 2. In this state, the legs 2 are maintained at the retracted position thereof.

Figure 5:
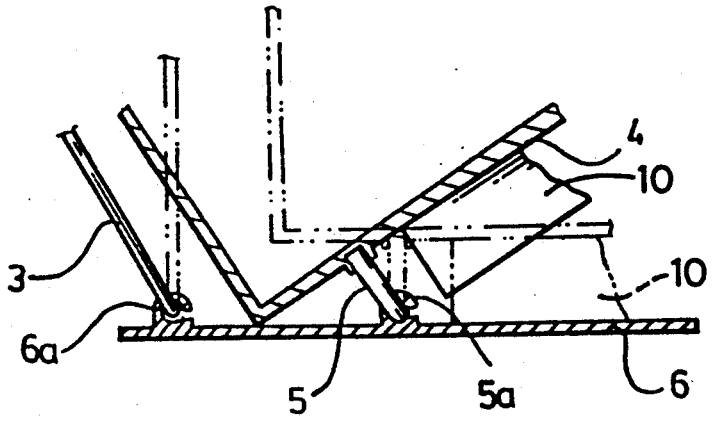
FIG. 5 is a partial sectional view of the base plate and the bottom member shown in FIG. 3, showing that the bag is stably maintained in its inclined position, by the base plate.

As the golf bag A is moved toward the inclined position thereof, for its use on the field, the bag body 1 is pivotally moved toward its inclined position about the pivot point a4 provided by the pivot member 5*a* on the base plate 6 which is in contact with the ground, as shown in FIG. 5. By the pivotal movement of the bag body 1 under the condition that the base plate 6 is still in contact with the ground, the pivot point a2 provided by the pivot member 3a is connected to each upper end of actuating member 3 is lifted with respect to the pivot point a1 provided by the pivot member 1a, thereby causing the pivot member 3a to pivot about the pivot point a1. As a result, the legs 2, to which the pivot members 3a are fixedly connected, pivot in clockwise to the extended position thereof, so that the golf bag A is stably maintained at its inclined position. At this time, the base plate 6 is depressed against the ground by the peripheral edge portion of the lower surface of bottom member 4, as shown in FIG. 5, thereby enabling more stable support for the golf bag A.

As the golf bag A is moved to its upright position after using golf clubs, the bag body 1 pivots about the pivot point a4 provided by the pivot member 5a to its upright position, thereby causing the pivot point a2 provided by each pivot member 3a to move downwardly. As a result, the pivot members 3a pivot in anti-clockwise so that the legs 2 pivot to the retracted position thereof. At the upright position of the golf bag A, the lower surface of the bottom member 4 is maintained horizontally and in parallel to the base plate 6, so that the golf bag A can be stably maintained at its upright position, by virtue of the base plate 6 and the base members 10 which are in contact with the ground again.

The above-mentioned operations can be apparent from the illustration of FIG. 6. That is, a parallelogram having four pivot points a1, a2, a3 and a4 is established at the upright position of the golf bag A. On the other hand, as the golf bag A moves to its inclined position, the parallelogram is changed into a parallelogram having four pivot points a1', a2', a3 and a4, thereby enabling the legs 2 to extend.

Figure 7:
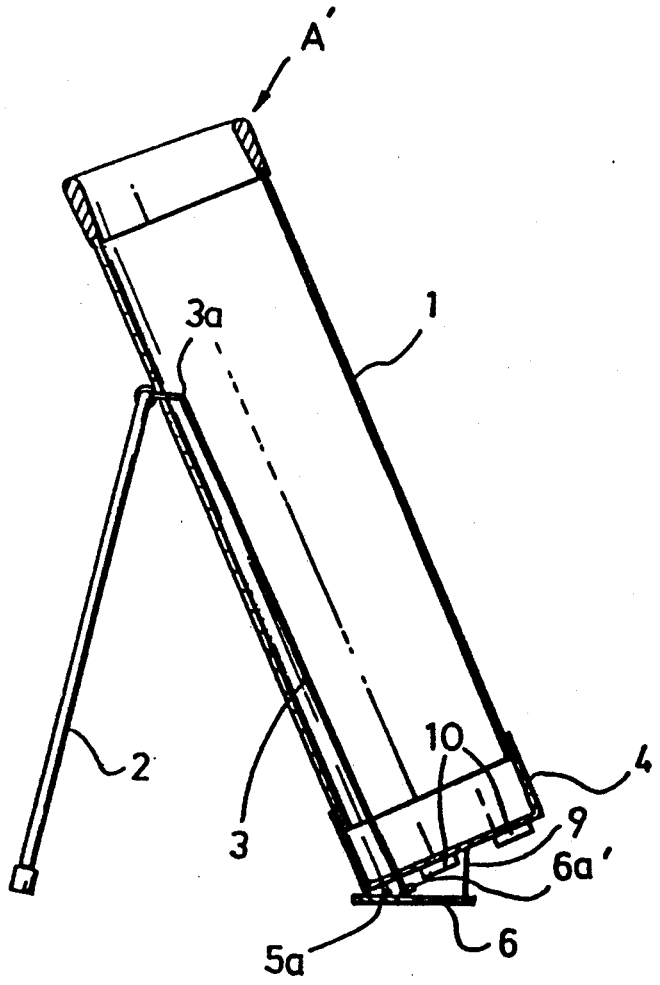
FIG. 7 is a sectional view of a golf bag with a support stand in accordance with a second embodiment of the present invention.

Referring to FIG. 7, there is shown a golf bag in accordance with a second embodiment of the present invention. This embodiment is different from the above-mentioned embodiment, in that the actuating member 3 is arranged inside the bag body 1 when viewed in side elevation and pivotally connected at its lower end to the base plate 6 by means of a pivot member 6a' disposed on the base plate 6 beneath the bottom member 4 and behind the pivot member 5a. In this case, the resilient member 9 is disposed between the bottom member 4 and the base plate 6. Other elements are substantially the same as those of the construction shown in FIGS. 1 to 4, so that they are designated by the same reference numerals as those of the latter case, respectively.

The operation of this embodiment is carried out in reverse, as compared with that of the embodiment of FIGS. 1 to 4. That is, as the golf bag A' is tilted, it pivots about the pivot member 5a on the base plate 6. At this time, the base plate 6 of large area is in contact with the ground, so that the golf bag A' is stably maintained during its pivoting. By the pivoting of the golf bag A', the pivot point a2 provided by each pivot member 3a moves downwardly with respect to the pivot point a1 provided by the pivot member 1a, thereby the legs 2 pivot clockwise to the extended position thereof. As a result, the golf bag A' is stably maintained at its inclined position. On the other hand, as the golf gag A' is moved to its upright position, the pivot point a2 is lifted, thereby causing the legs 2 to pivot to the retracted position thereof.

Figure 8:
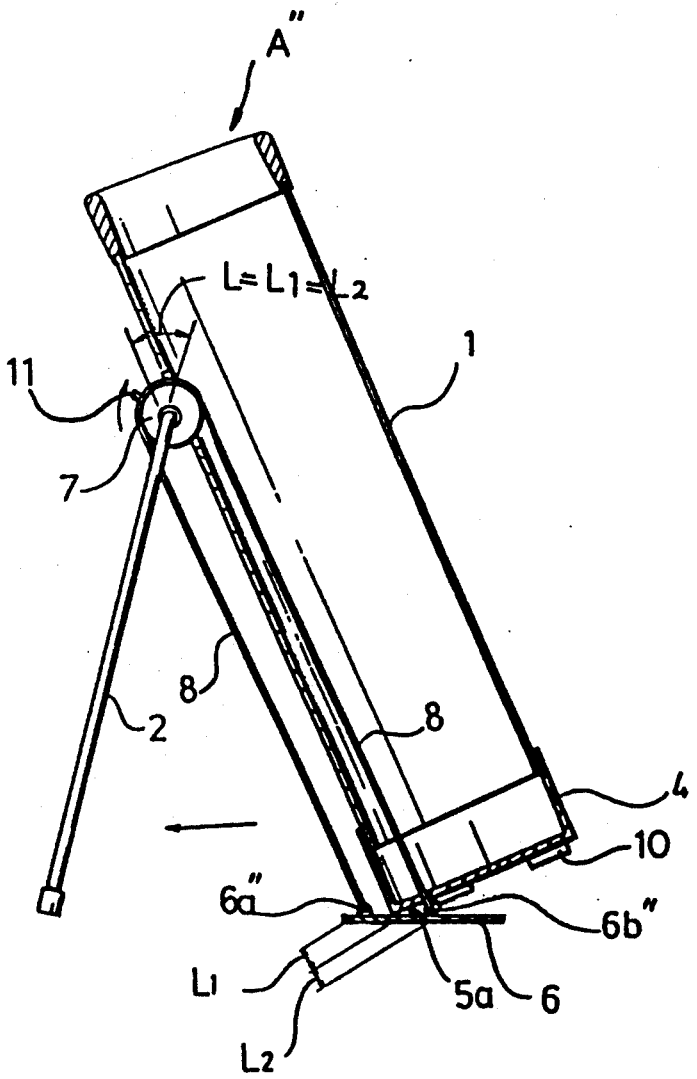
FIG. 8 is a sectional view of a golf bag with a support stand in accordance with a third embodiment of the present invention.

Referring to FIG. 8, there is shown a golf bag in accordance with a third embodiment of the present invention. This embodiment employs leg actuating means having a construction different from those of the above-mentioned embodiments. That is, the golf bag A" comprises a pulley-belt mechanism including a pair of pulleys or rollers 7 fixedly mounted to respective upper ends of legs 2 and a pair of belts 8 adapted to operatively connect the pulleys 7 with the base plate 6, respectively. Each belt 8 extends tightly from one end thereof connected to a front connector 6a" on the front portion of the base plate 6 to the other end thereof connected to a rear connector 6b" on the rear portion of the base plate 6, via the outer peripheral portion of the pulley 7. The belt 8 is fixed to the outer peripheral portion of the pulley 7 by means of a suitable fixer such as a rivet 11 so that it moves integrally with the pulley 7.

As the bag body 1 is tilted, each belt 8 is moved toward its other end connected to the rear connector 6b". That is, the length of the front belt portion of each belt 8 is reduced by the length L1, while the length of the rear belt portion of each belt 8 is increased by the length L2 which corresponds to the length L1, as shown in FIG. 8. Of course, the total length of each belt 8 is constant. Accordingly, the pulleys 7 rotate the length L which also corresponds to the length L1 and the length L2, thereby causing the legs 2 to rotate clockwise to the extended position thereof. On the other hand, as the bag body 1 moves to its upright position, the front belt portion of each belt 8 is increased by the length and the rear belt portion of each belt 8 is reduced by the length L2. As a result, the pulleys 7 rotate the length L in anti-clockwise, thereby causing the legs 2 to return to the retracted position thereof.

As apparent from the above description, the golf bag of the present invention comprises a base plate pivotally mounted to the bottom of the bag. The base plate has sufficient width and length to stably support the bag. The stability of the bag is ensured at both inclined and upright positions, in that the base plate is always in contact with the ground. The golf bag stand of the present invention is simple and compact in construction. The stand is also convenient in use, in that the legs are automatically extended only by tilting the bag and automatically retracted only by vertically standing the bag without any further manipulation. By virtue of the simplified construction, the failure of the stand is hardly generated. In particular, the stand can be easily applied to existing golf bags.

It must be understood that many alterations and modifications may be made by those having ordinary skill in the art to the structures disclosed herein without departing from the spirit and scope of the invention. Therefore, the presently illustrated embodiments have been shown only by way of example and should not be taken to limit the scope of the following claims.

What is claimed is:

1. A golf bag comprises a bag body and a pair of support legs pivotally mounted at their upper ends to said bag body by means to pivot members attached to the bag body, respectively, so as to pivot between extended and retracted positions thereof, the golf bag further comprising:

a bottom member constituting the bottom of bag body and having a flat lower surface;

a base plate disposed beneath said bottom member to be contactable with the ground and pivotally connected to the bottom member, by means of a generally U-shaped connecting rod pivotally mounted to said lower surface of the bottom member, said base plate having at least one first pivot member to which the lower end of said connecting rod is pivotally connected so that the bag body pivots between its inclined and upright positions about said first pivot member on the base plate which is in contact with the ground;

actuating means adapted to pivot said legs according to the pivoting the bag body; and a plurality of downwardly extending base members provided at the lower surface of bottom member, except for at least the front portion of said lower surface, and arranged radially and inwardly from the periphery of the lower surface of bottom member and circumferentially spaced from one another, each of said base members having a certain vertical length such that its bottom surface is flush with the lower surface of base plate when the bag body is maintained at its upright position.

2. A golf bag in accordance with claim 1, wherein said actuating means further comprises a generally U-shaped actuating member having upper ends pivotally mounted to the upper ends of the legs by means of pivot members fixedly attached to said upper ends of legs, respectively, and a lower end pivotally mounted to the base plate by means of a second pivot member provided at the base plate.

3. A golf bag in accordance with claim 2, wherein said second pivot member on the base plate is positioned at a front portion of the base plate outside the bottom member so that the actuating member is arranged outside the bag body when viewed in side elevation.

4. A golf bag in accordance with claim 3, wherein a resilient means having two ends is connected at one end thereof to the actuating member and at the other end thereof to the bag body, so as to always urge the actuating member downwardly and towards the bag body, that is, in the direction of forcing the legs to move to the retracted position thereof.

5. A golf bag in accordance with claim 2, wherein said second pivot member on the base plate is positioned beneath the bottom member and behind the first pivot member, which is disposed on the base plate, the actuating member being disposed inside the bag body.

6. A golf bag in accordance with claim 5, wherein a resilient means having two ends is disposed between the bottom member and the base plate to urge the bag body toward its upright position by forcing the legs to move to a retracted position.

7. A golf bag in accordance with claim 1, wherein said actuating means further comprises: a pulley-belt mechanism including a pair of pulleys, each fixed to respective upper ends of the legs; and a pair of belts, each connected to a front portion of the base plate, thereafter disposed upward and around a pulley to which it is fixed by a rivet, and thence downward through the bag to the base plate, being fixedly secured thereto at a position proximate said first pivot member so that movement of the bottom respective of the base, plate urges belt actuation of said pulleys and thereby a rotation of said legs mounted fixedly on said pulleys.

8. In a golf bag stand for supporting an inclined golf bag which is characterized by a tubular bag having a closed planar bottom, an open top, a back, strapped portion and a front portion bearing a support extension mechanism, an improvement for posturing the bag stably on both upright and inclined positions comprising:

a plurality of short, downwardly extending base members which depend from and comprise a peripheral array about the planar bottom;

a plate means comprising a base plate movably disposed in parallel planar relationship with the bottom and hingedly mounted to the bottom by a hinge means which is disposed on and depends vertically downward from the bottom, said base plate being further disposed in relation to the array of base members so as to cooperate with the base members to support the bag in said upright position;

said hinge means further comprising a short rod connected fixedly to the bottom and hingedly to the plate; and said support mechanism comprising a pair of elongate set-apart support members each including means for pivotally mounting said supporting members proximate the front-top portion of the bag and means for pivotally coupling said support members to an upper portion of a downwardly extending connector means, said connector means mounted at a lower portion thereof to said plate means such that, when the support members are extended to support the bag in said inclined position, the plate means pivots to support the bottom in cooperation with the extended support members.

9. The invention of claim 8 wherein said short rod coextensively depends from the bottom of the bag and cojoins the base plate at a pivot point disposes thereon such that, when the bag is stood upright, the short rod is substantially perpendicular to the bottom and to the base plate and, when the bag is inclined toward its front, a triangle is formed between the short rod, the bottom and the base plate.

* * * * *